US006665990B1

(12) United States Patent
Cody et al.

(10) Patent No.: US 6,665,990 B1
(45) Date of Patent: Dec. 23, 2003

(54) HIGH-TENSION HIGH-COMPRESSION FOUNDATION FOR TOWER STRUCTURES

(75) Inventors: William K. Cody, Minnetonka, MN (US); John R. Larson, Bloomington, MN (US); Jerome A. Grundtner, Forest Lake, MN (US)

(73) Assignee: Barr Engineering Co., Minneapolis, MN (US)

( * ) Notice: Subject to any disclaimer, the term of this patent is extended or adjusted under 35 U.S.C. 154(b) by 0 days.

(21) Appl. No.: 09/519,823

(22) Filed: Mar. 6, 2000

(51) Int. Cl.[7] ..... E02D 27/12; E02D 27/42

(52) U.S. Cl. ..... 52/295; 52/296; 52/741.15; 405/244; 405/252.1

(58) Field of Search ..... 52/111, 153, 156, 52/157, 158, 166, 169.9, 295, 296, 741.15, 745.04, 745.17; 405/228, 244, 232, 252.1

(56) References Cited

U.S. PATENT DOCUMENTS

| | | | | |
|---|---|---|---|---|
| 1,164,085 A | * | 12/1915 | Goldsborough | 405/244 |
| 1,584,203 A | * | 5/1926 | Upson | 405/228 X |
| 1,898,304 A | * | 2/1933 | Kent | 264/31 |
| 2,741,910 A | * | 4/1956 | Thornley | 52/169.9 X |
| 3,006,626 A | * | 10/1961 | Lejeck et al. | 165/9.3 |
| 3,364,636 A | * | 1/1968 | Salsig, Jr. | 52/169.9 |
| 3,969,853 A | | 7/1976 | Deike et al. | |
| 3,969,854 A | | 7/1976 | Deike et al. | |
| 4,031,687 A | * | 6/1977 | Kuntz | 52/741.15 |
| 4,590,718 A | | 5/1986 | Angeloff et al. | |
| 4,650,372 A | * | 3/1987 | Gorrell | 405/232 |
| 4,687,415 A | | 8/1987 | Bender et al. | |
| 4,707,956 A | * | 11/1987 | Sato | 52/169.9 X |
| 4,911,581 A | * | 3/1990 | Mauch | 405/232 |
| 4,999,966 A | | 3/1991 | Johnson et al. | |
| 5,012,622 A | | 5/1991 | Sato et al. | |
| 5,050,356 A | | 9/1991 | Johnson et al. | |
| 5,472,311 A | | 12/1995 | Davis et al. | |
| 5,586,417 A | | 12/1996 | Henderson et al. | |
| 5,689,927 A | | 11/1997 | Knight et al. | |
| 5,722,498 A | | 3/1998 | Van Impe et al. | |
| 5,794,387 A | | 8/1998 | Crookham et al. | |
| 5,826,387 A | | 10/1998 | Henderson et al. | |
| 5,960,597 A | | 10/1999 | Schwager et al. | |

OTHER PUBLICATIONS

State of Alaska, Department of Transportation and Public Facilities, Report No.: FHWA–AK–RD–87–16, Use of Fins on Piles for Increased Tension Capacity (Spin–Fin Piles). Report date: Feb., 1987.

* cited by examiner

*Primary Examiner*—Brian E. Glessner
(74) *Attorney, Agent, or Firm*—Gray, Plant, Mooty, Mooty & Bennett PA; Malcom D. Reid; Cecilia M. Jaisle

(57) ABSTRACT

An above ground tower foundation uses embedded tension/compression components secured to a ground level cap. The components each terminate distally in a below ground soil or rock anchoring structure. The components embed without deep wide area site excavation or dewatering. The components with their distal anchoring structure provide exceptional bearing and tension capacity to the foundation, and high resistance to overturning moments acting on the tower. The tension/compression components may be straight or tapered piles with distal end helical fins, piles with a distal end grouted soil or rock anchor, caissons with a distal belled section, caissons with a distal end grouted soil or rock anchor, helical screw anchors or any combinations thereof Construction of this foundation comprises the following steps. A minimal ground-level excavation is established for the cap. The tension/compression components embed into deep, high-strength soil layers without deep below ground excavation. The cap is formed. The components are secured to the cap. The tower attaches to the cap. Preferred tension/compression components are spin-fin piles—a pile with a helical fin at the distal pile end. The tension/compression components may be battered outwardly from the cap and tower.

20 Claims, 10 Drawing Sheets

HIGH-TENSION HIGH-COMPRESSION FOUNDATION FOR TOWER STRUCTURES

FIELD OF THE INVENTION

The present invention relates to the structure and method of installation of a deep foundation to support large diameter, tall towers in a wide range of soil conditions. The inventive foundation exhibits high tension, high compression and high resistance to overturning moments acting on the supported tower. The inventive foundation depends, on below ground embedded tension/compression components that each terminate in a distal formation of enhanced bearing, tension and compression capacity. The embedded component may be driven into position, eliminating the effort, expense and time for deep wide-area site excavations and dewatering. This inventive deep foundation is especially suitable for support of tall tubular towers, such as wind turbines.

DESCRIPTION OF RELATED ART

Various installations require foundations to support tall large diameter tubular towers. Such installations include power generating wind turbines, power line towers, transmission and communication towers, fluid tank (water) towers, emission stacks and similar tower structures. The towers are typically round, fabricated from welded plates, and have a horizontal circular flange plate (or cap) for anchor bolt connection at the ground level base of the tower. The towers are generally steel, with a relatively large base diameter (about 8 feet or greater). The towers may be more than about 100 feet tall and subject to very large overturning moments with relatively moderate lateral loads and small vertical loads.

Conventional foundations for such towers have required large embedments, such as large diameter piers, cylinders or gravity-spread foundations. Conventional foundations for wind turbine towers have become very large and expensive, as the size of the wind turbines and the height of the towers has increased. Conventional gravity-spread foundations may require a below ground maximum diameter of about 40 feet to bout 50 feet to support a tower pedestal of about 15 feet in diameter.

Conventional gravity-spread foundations require a substantial below ground mass and depend, largely, on the vertical or lateral bearing capacity of soils near the surface. If the bearing capacity of the deeper soils or the weight of the upper level mass of soil is needed, large deep wide-area excavations are required. As used herein, the term "excavation" refers to cutting and digging a large diameter cavity and to scooping out and removing the soil generally to the full depth and diameter of the hollowed-out cavity. Deeper larger diameter foundations spread the load of the above-ground structure, but add to the cost, time and difficulty of installation. High groundwater can require dewatering operations that complicate and increase the cost of deep, wide area excavations for conventional gravity-spread foundations.

U.S. Pat. No. 5,586,417, issued Dec. 24, 1996, entitled Tensionless Pier Foundation and U.S. Pat. No. 5,826,387, issued Oct. 27, 1998, entitled Pier Foundation under High Unit Compression each describe large diameter below ground foundations of poured-on-site cementitious monolithic construction. The foundations described in these two patents currently are a foundation of choice for wind turbine installations. The foundations of these patents use two concentric corrugated cylinders, requiring extensive deep wide area site excavation and subsequent back filling and compacting. These patents require high compression of the anchor bolts on the poured foundations and large soil mass to achieve resistance to large overturning moments on the supported tower. The present inventive foundation answers a need to avoid labor-intensive deep, wide area site excavation, controlled replacement of soil and expensive fabricated steel matrix reinforcement. The inventive foundation requires a smaller amount of concrete than conventional foundations, such as those described in these two patents.

SUMMARY OF THE INVENTION

An embedded high-tension, high-compression foundation for an above ground tower comprises a ground level cap, attachments for securing the tower to the cap and below-ground embedded tension/compression components. The tension/compression components are each secured to the cap and each terminate distally with a below ground anchoring structure. The anchoring structure provides embedded below ground tension retention of the components within the deep level soil and/or rock mass. The components extend to deep, high-strength soil layers. The components are embedded without the need for deep wide area site excavation. The foundation of this invention requires only shallow excavation near the surface for placement of the cap. The components with their distal anchoring structure provide exceptional bearing and tension capacity, and high resistance to overturning moment forces acting on the supported above-ground structure.

The cap may be steel reinforced concrete. The attachments for securing the tower to the cap may be conventional anchor bolts or a flange structure for bolt attachment, such as a steel embedment with a circular flange plate for bolt attachment. As used herein, the terms "tension/compression component," "embedded component," or simply "component" refer to a below ground embedded element that extends to a desired below ground depth and terminates in a distal formation contributing enhanced bearing, tension and compression capacity to the component and the supported above-ground structure. Non-limiting but illustrative examples of such components include piles with distal end helical fins, piles with a distal end grouted soil or rock anchor, piles with distal end helical soil or rock anchors, caissons with a distal belled section, caissons with a distal end grouted soil or rock anchor, caissons with distal end helical screw anchors or any combinations thereof. A pile with distal end helical fins is a pile with one or more fins welded or otherwise formed at the pile distal end in a helical or spiral configuration. Such a pile has been referred to as a "spin-fin pile." The distal formation contributing enhanced bearing, tension and compression capacity to the component may be preformed or may be formed in place. Thus, a suitable tension/compression component may be structured as follows. A pile constructed with side apertures adjacent the distal end of the pile is driven to its desired belowground position. To prevent occlusion of the pile lumen with rock and/or soil debris during driving, the pile may have a suitable closed distal end, such as a threaded or non-threaded point or auger tip. A suitable resinous fluid is introduced to the pile interior to permeate through the apertures and bond with the surrounding deep soil. If the components are hollow, they may then be filled, for example, with concrete. The components may be straight or tapered. If the components are tapered, they taper from a larger cross-sectional area near the soil surface to a smaller cross-sectional area at deep soil areas.

This invention is also a method of constructing an embedded high-tension, high-compression foundation for an above ground tower. A minimal ground-level excavation is established for the cap. Tension/compression components are embedded into deep, high-strength soil and/or rock layers to provide exceptional bearing and tension capacity. The distal anchoring means of the embedded components provide high-tension retention within the mass of deep, high-strength soil and or rock layers. The components are embedded by driving, augering, drilling, and the like, without the need for deep below ground wide-area excavation.

As used herein, the term "embedding" refers to a process for positioning the component by locating the component at ground level above its desired final location and imparting impetus to forcibly plunge the component through the intervening soil and/or rock formations. The impetus and/or the shape of the component (e.g., a spin fin pile) may cause the component to rotate slightly while advancing to its desired final location. "Embedding" also refers to a process of positioning the component by establishing a hole in the intervening soil and/or rock formations of essentially the same or only slightly larger diameter than the component, so that the embedded component may be advanced or lowered into its desired final location within the hole. Alternatively, the component may be formed in place within the established hole. The process of establishing a hole may be by piercing, sinking or penetrating a hole sized to or only slightly larger than the component, in essentially a straight line. Typically, when the component is based on a pile, embedding may be by imparting impetus to plunge the component forcibly to its desired position. When the component is based on a caisson, embedding may be by establishing a hole of essentially the same or only slightly larger diameter than the caisson and forming the caisson in place.

The cap is then formed and the components are secured to the cap by any suitable method. Forming the cap may comprise placing formwork for the cap, including reinforcement and means for attachment of the tower, placing concrete in the formwork, stripping the formwork, and backfilling and compacting around the cap. The tower is then attached to the cap by any suitable method. The cap may be a horizontal circular flange plate. The reinforcement may be steel. The attachments may be anchor bolts. Spin fin piles and other components that are pipe piles (such as the straight or tapered piles with distal end helical rock or anchor screws and piles with a distal end grouted soil or rock anchor) may be embedded by driving, drilling or augering. The pipe pile may be driven with or without an end plate. If the tension/compression components are caissons, the only formation of a hole essentially sized to the caisson is required and the caisson is formed in its embedded position. Auguring or similar drilling methods may form a hole for formation and positioning of the caisson. The tension/compression components may be filled, for example, with concrete. The tension/compression components may be battered outwardly from the cap and tower.

DETAILED DESCRIPTION OF THE INVENTION

Figure 1:
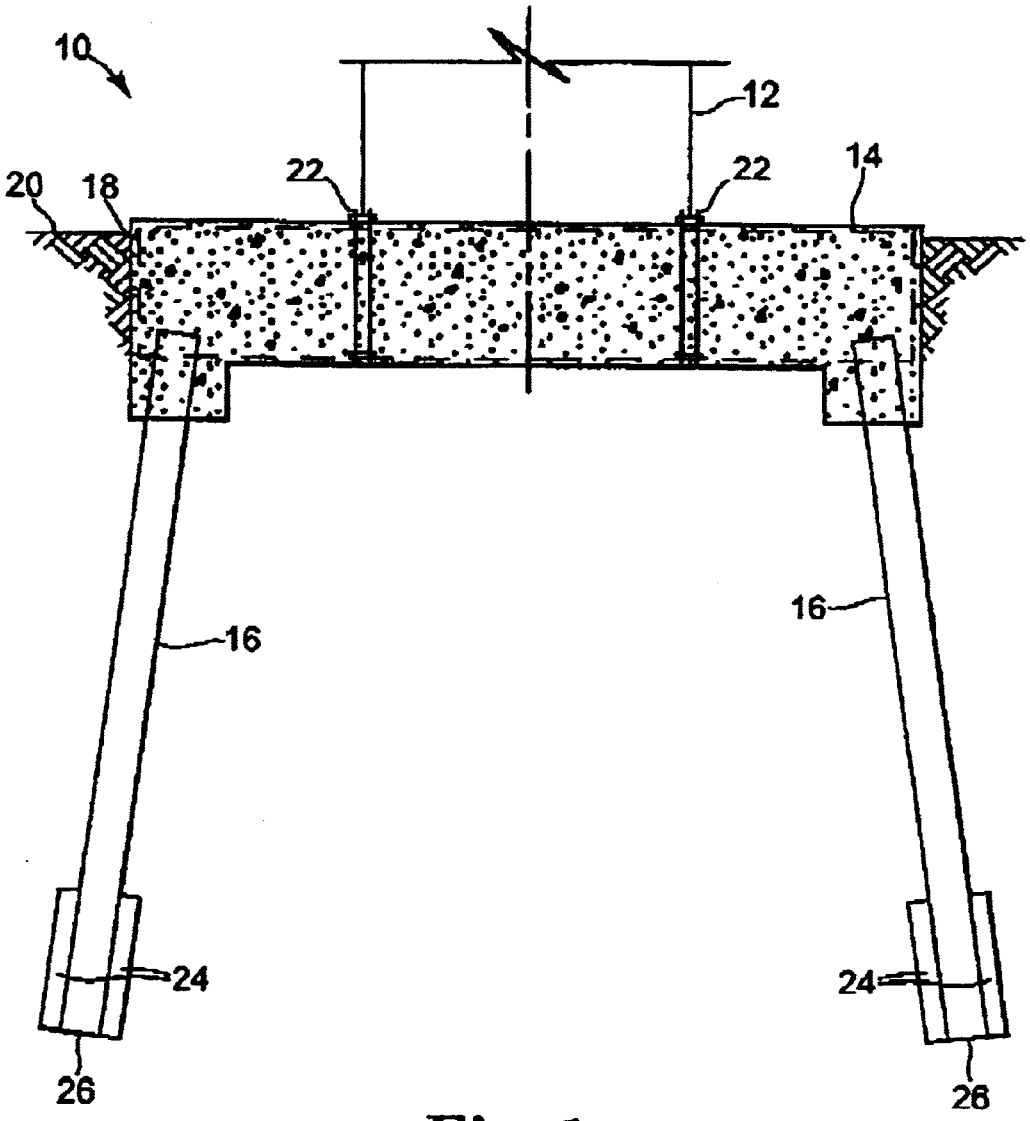
FIG. 1 is a cross-sectional view of the tubular tower, concrete cap with anchor bolts, and spin-fin pile components.

The present inventive foundation includes a ground-level cap and a deep below ground foundation system. The deep foundation of the present invention extends to deeper and generally higher-strength soil layers with minimal excavation and dewatering. The embedded foundation system provides enhanced end bearing, tension and compression capacity. The embedded foundation system may include such components as piles with distal spiral fins, a drilled caisson with a distal end belled section, or a driven pile or caisson with an embedded grouted soil or rock anchor. The inventive foundation is particularly adapted for supporting tall, large-diameter, tublar towers susceptible to high overturning moment forces, moderate lateral loads, and relatively light vertical loads. The above ground structure supported by the foundation of this invention resists overturning moment forces of greater than 20,000,000 lb./ft., lateral loads of more than 110,000 lbs. and vertical loads of more than 286,000 lbs. This type of loading commonly occurs with tubular wind turbine foundations having cylindrical diameters of about 8 feet, 12 feet, 24 feet or even larger and with tower heights ranging from about 100 feet to more than about 300 feet. The above ground weight of such towers may reach or exceed about 286,000 lbs. These towers may support wind turbines with a large diameter propeller at the top of the tower. The large diameter propeller may contribute large overturning moment forces and moderate lateral loads. Other tall, large-diameter tower structures with relatively small vertical loads may also use the inventive foundation. Examples of other towers supportable by the foundation of this invention include communication towers, power line towers, outdoor lighting, advertising, traffic control signs and signals, bridge supports, ski lifts, gondolas, fluid tank (water) towers, mission stacks and the like.

The inventive foundation can extend to depths of from about 25 feet up to about 60 feet and even to about 100 feet. Deep foundations of this invention provide greater resistance to overturning moment forces acting on the above ground structure. The inventive foundation exhibits exceptionally high tension from about 50,000 lbs. to about 150,000 lbs. for each pile. The compression for this inventive foundation is approximately 50 percent higher than the tension capacity, that is, from about 75,000 lbs. to about 225,000 lbs.

The inventive deep foundation derives enhanced bearing, tension and compression capacity from the structure of the distal below ground end of the embedded foundation. Compression resistance for any embedded foundation is typically easier to achieve than tension resistance. An important characteristic of the foundation is a deep foundation with a high-tension capacity. With typical conventional foundations, there is either no tension capacity or a nominal tension capacity of up to about 25 percent, typically no more than 10 percent. A characteristic of the tension/compression components of the foundation of this invention is that only the distal below ground end of the component is constructed to provide retention within the terminal soil and/or rock mass. The construction of the distal below ground end of the component may be of larger size and mass than the remainder of the upper length of the component. The larger size or mass of the distal end of the component provides a bearing surface for the surrounding soils and/or rock mass. The construction of the distal below ground end of the component may also terminate in rock or soil anchors, augers or screws that provide increased positive retention and frictional resistance to pullout or overturning forces, as well as anchoring the component distal end into the surrounding soil and/or rock mass. The tension/compression components include piles or caissons constructed with distal terminal structures to increase the pullout strength of the foundation. The pile distal end may be constructed with helical or spiral fins. The caisson distal end may be constructed with a belled section. A grouted soil or rock anchor may be provided at the distal below ground end of the caisson or pile. A caisson with a helical screw anchor or with a grouted anchor may be used. Each of these distal below ground structures is engineered to enhance the tension capacity or bearing area and the positive retention and frictional resistance of the embedded foundation. The resulting foundation benefits from the compression (bearing), tension, and the lateral loading capacity of the deep embedded foundation.

The tension/compression components of this foundation install at exceptional savings of time and cost. Pile components may be installed by driving. Caisson components may be installed by augering or drilling. The driven components can be battered during installation. The driven components are self-tested upon installation. The driven components displace the soil thereby increasing adjacent soil density and strength. The amount of energy required to drive the component to its final depth determines the tension-compression capacity of each component. Each component can be driven to an individually selected depth, dependent on the soil and/or rock characteristics at the base of each component. It is not possible to judge strengths of deeply embedded soil and/or rock conditions accurately before foundation construction. Also, soil strengths and/or rock conditions can vary across the site area. With the foundation of this invention, each component can be driven to an individually determined depth. The driving resistance of each component serves as a test that can be correlated to the component's axial/uplift capacity. Typically, better soils, in terms of supporting a foundation, exist at deeper levels. The below ground distal ends of the components of the present invention are constructed to provide greater resistance to take advantage of the location of these better soils. The energy required to drive a component of the present inventive foundation is correlated to shallower penetration than that for the foundations described above in U.S. Pat. Nos. 5,586,417 and 5,826,387 with improved pull out strength.

Piles with helical or spiral fins at their distal below ground end are referred to as "spin fin piles." Spin fin piles are described in a State of Alaska, Department of Transportation and Public Facilities Report No. FHWA-AK-RD-87-16, dated February 1987. Spin fin piles demonstrate great resistance to pull out and a large downward capacity. Spin fin piles have the advantage of positioning with minimal excavation and with a one-step driving operation. The fins of the spin fin piles strengthen and stiffen the distal end of the pile. The condition of the soil and/or rock, at the installation site determines the fin length. Typically, the less dense the soil, the longer the helical fins need to be, that is, the longer the distal end length of the pile around which the fins need to spiral. Generally, for purposes of this invention, about 10–25 percent, typically about 20 percent, of the distal end length of the pile is constructed with helical fins. Installing the components by driving is more efficient and less expensive than installing other foundations that require deep, wide excavations. Driving densities the soil adjacent the components as the components are embedded, increasing the soil strength. Other conventional foundations require artificial compaction of the soils to achieve the soil strength inherently achieved by driving installation of the components of the inventive foundation. In many cases, recompaction of the existing soils with other conventional foundations is impractical.

With conventional foundations, the structure of the cap extends much deeper into the ground and anchor bolts in the cap usually extend to near the bottom of the foundation. With the foundation of this invention, the cap, typically concrete, is located near the surface of the ground and the tension/compression components extend much deeper below ground. The components secure to the cap by attachments such as anchor bolts. The anchor bolts for the cap of the present invention are much shorter than with conventional foundations and need not embed so deeply into the cap.

The high-tension capacity, deep foundation of this invention uses a greatly reduced mass of concrete, in comparison to the mass of concrete needed in a conventional gravity-spread foundation. Typically, the inventive foundation requires only about one-third the volume of concrete required for a traditional spread foundation. The components may be at least partially hollow or open-ended. Filling the components with concrete is optional for the inventive foundation. Filling the components with concrete adds strength and desirably minimizes the amount of steel in the foundation. Generally, only the upper portion of the component (about the upper one-third) needs to be concrete filled to increase the bending capacity of the component near the cap. The entire length of the component may be concrete filled if desired.

The inventive foundation also decreases dependence on the lateral bearing capacity of a large diameter pier or cylinder, used in conventional foundations, eliminating the need for a large mass of concrete or for deep excavations. The benefit of the present inventive foundation system, in comparison to other systems, increases as the magnitude and proportion of overturning moment of the supported above ground structure increases. As wind turbine technology continues to advance to higher capacity wind turbines on taller towers, the need for and benefits of the high-tension high compression foundation of this invention will continue to increase.

Figure 2:
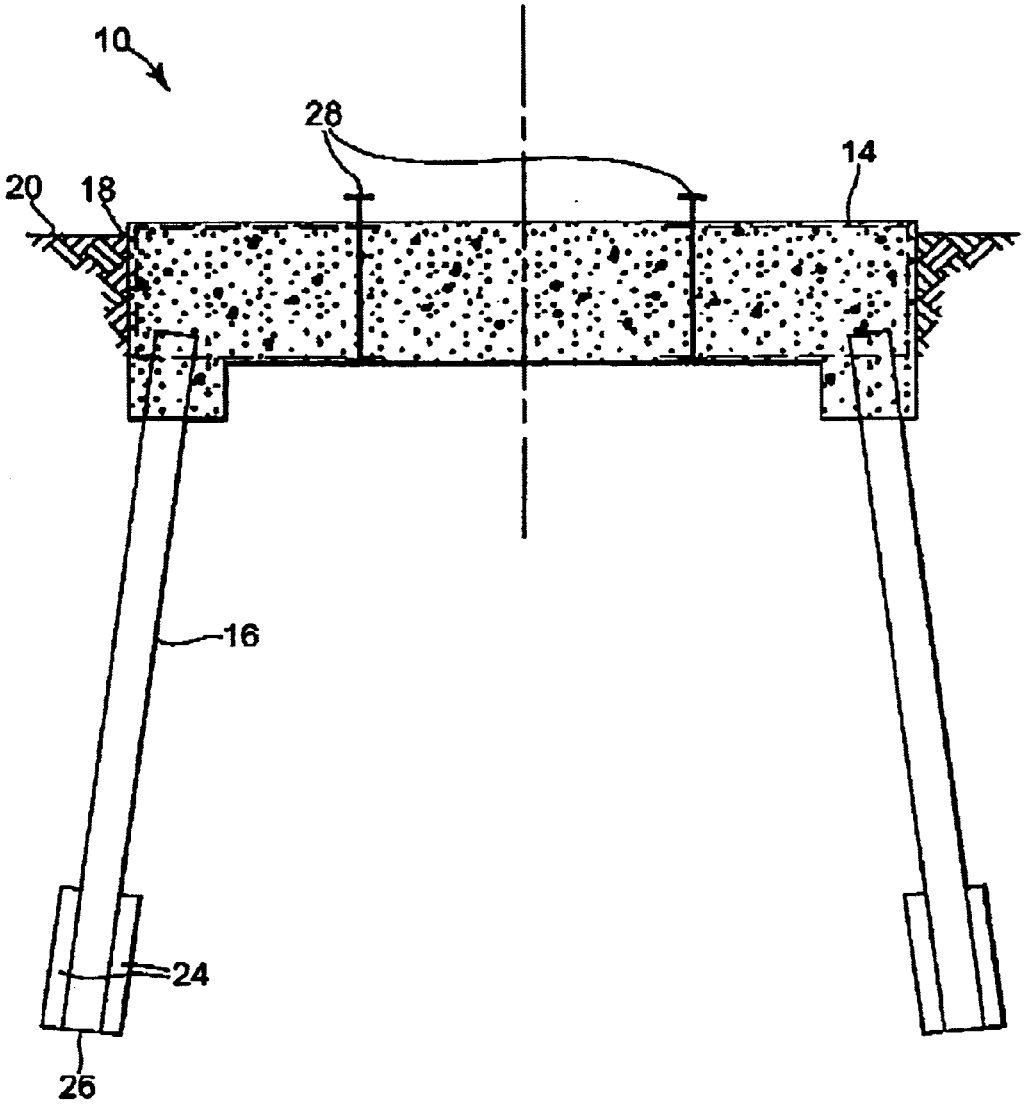
FIG. 2 is a cross-sectional view, similar to FIG. 1, in which a tubular tower attachment substitutes for the anchor bolts.

The present invention encompasses a wide range of embodiments of the high-tension, compression deep foundation. A presently preferred embodiment uses the "spinfin" pile embedded foundation system for a wide range of soil conditions. FIGS. 1, 2 5A and 5B illustrate spin fin piles 16 for the foundations of this invention. Spin fin piles 16 are constructed with spiral or helical fins 24 at their distal below ground ends 26. A spin-fin wind turbine foundation 10 of this invention, as seen in FIG. 1, supports a wind turbine tower 12 and other, similar support towers. This foundation 10 can generally be described as a pile foundation with a concrete cap 14 for attachment of the above ground tower 12 and below ground tension/compression components. In FIG. 1, the components are spin fin piles 16. To install the foundation 10 shown in FIG. 1, a shallow excavation 18 in the surface soil 20 is formed for placement of the cap 14. The desired number and arrangement of spin fin piles 16 are driven into position battered radially outward from the cap 14 and supported tower 12. If required for a particular installation, the piles 16 may be concrete filled. Formwork (not shown) is placed for the cap 14. Attachments, such as anchor bolts 22, for the tower 12 are positioned in the formwork. FIG. 2, a cross-sectional view of the foundation 10 similar to FIG. 1, shows a tubular tower attachment 28 that substitutes for the anchor bolts 22. The fins 24 are helically welded steel plates located on the distal lower portion of straight or tapered pipe piles 16, which may have a round or other cross-section. Where the pipe piles 16 are tapered, they taper from a larger cross-sectional area near the soil surface to a smaller cross-sectional area at deep soils. Piles 16 are typically of steel. The addition of helical or screw-type fins 24 to the piles 16 significantly increases the ultimate compression and tension capacity of the piles 16.

Figure 3:
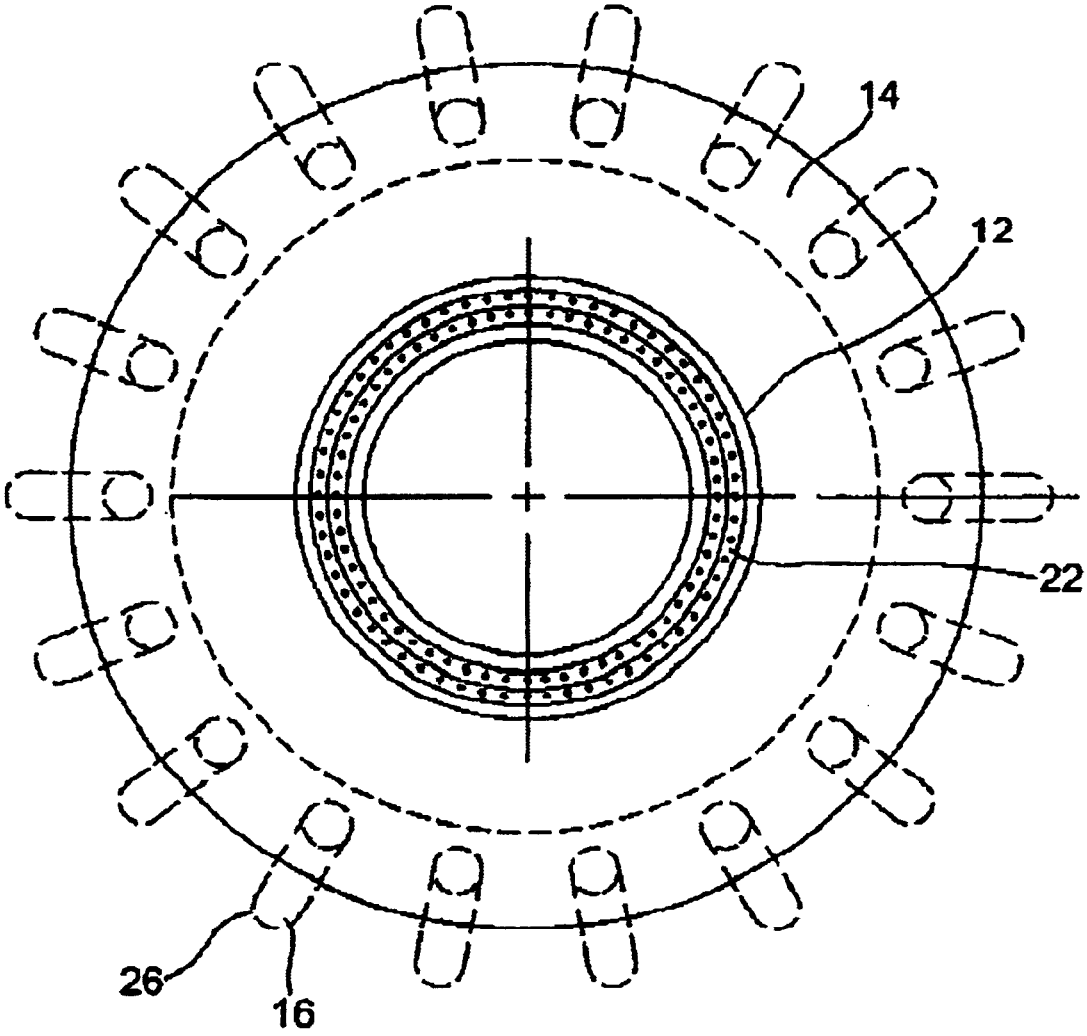
FIG. 3 is a plan view of the tubular tower concrete cap and spin-fin pile.
Figure 4:
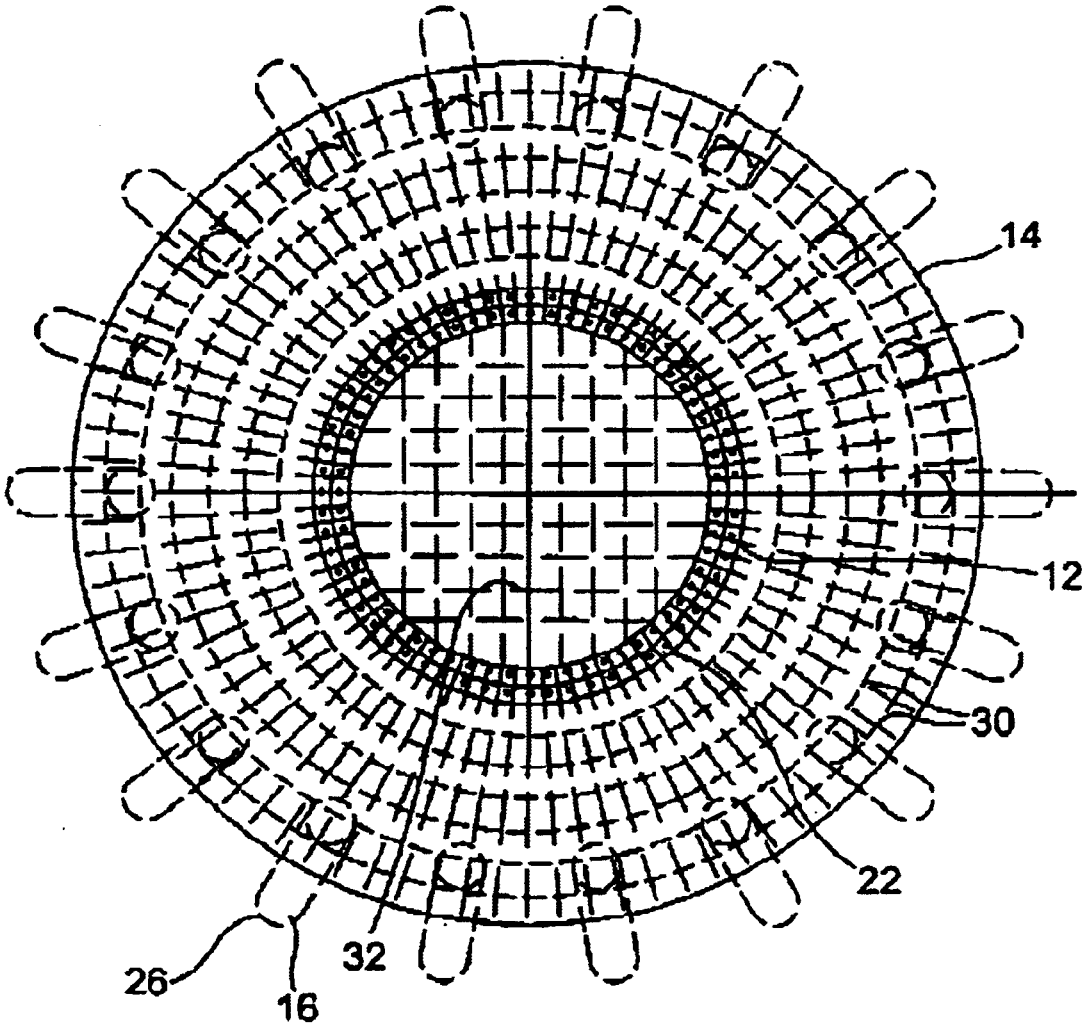
FIG. 4 is a plan view of the foundation with reinforcing bars embedded in the concrete of the cap.

FIG. 3 is a plan view of the foundation 10 with the spin fin pile 16, the tower 12, and the cap 14. If required for a particular installation, reinforcement for the cap 14 may be added to the formwork, as illustrated in FIG. 4. FIG. 4 is a plan view of the foundation 10 with circular reinforcing bars 30 embedded in the concrete of the cap 14 and a center reinforcement bar mat 32. Concrete is positioned in the formwork and allowed to set. The formwork is stripped and soil 20 is backfilled and compacted around the cap 14.

Figure 5A:
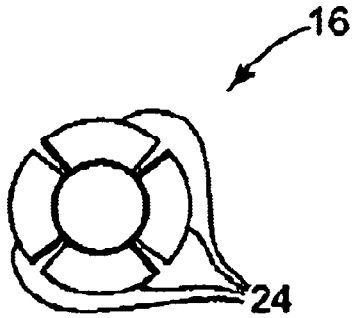
FIGS. 5A and 5B show an end view and perspective view of the distal below ground end of a spin fin pile, showing the helical or spiral fins.
Figure 5B:
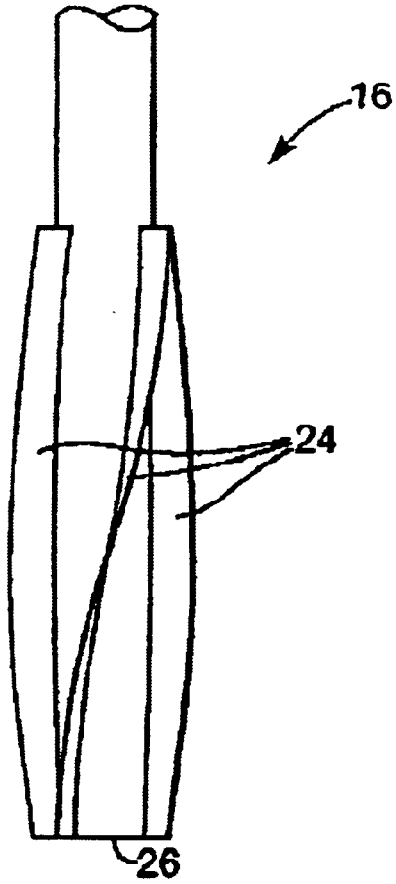
Figure 7:
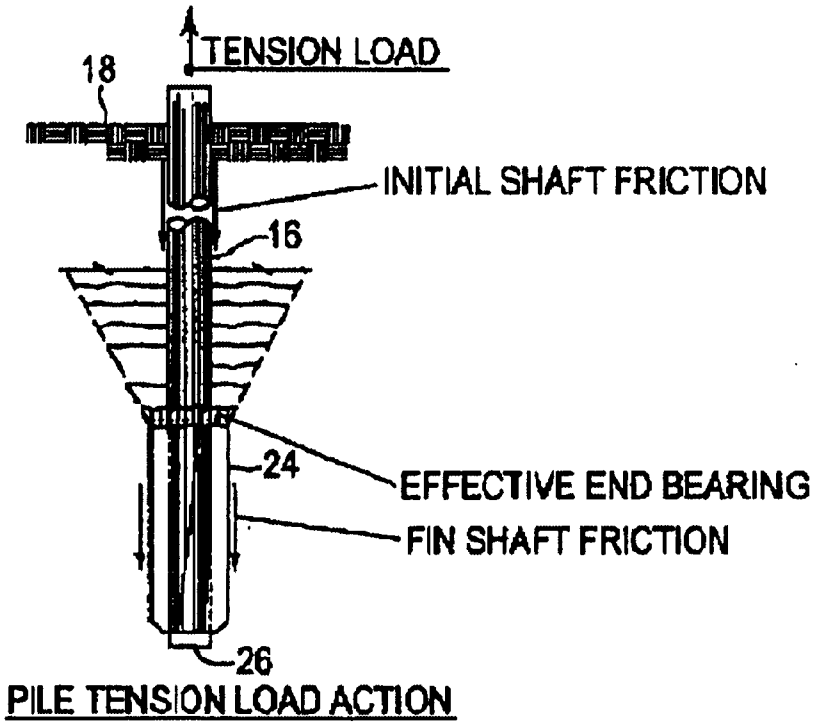
FIG. 7 illustrates pile tension load action of a spin fin pile.
Figure 6:
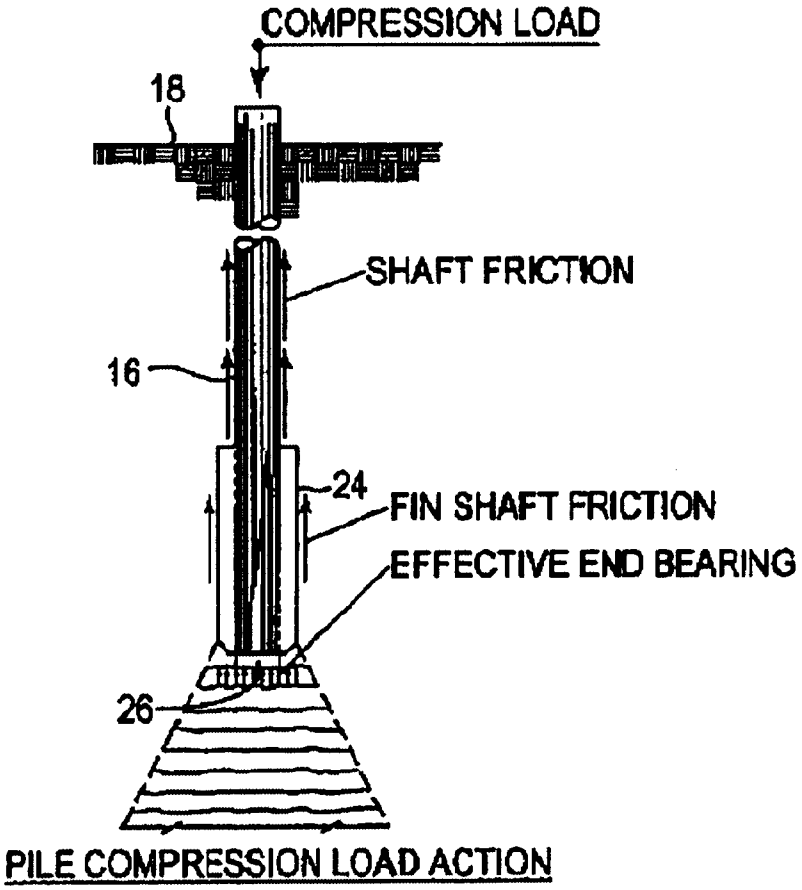
FIG. 6 illustrates pile compression load action of a spin fin pile.

FIGS. 5A and 5B show an end view and perspective view of the distal below ground end of a spin fin pile 16, showing the helical or spiral fins 24. FIG. 6 illustrates pile compression load action of a spin fin pile 16, as in driving the pile 16 into embedded position. During the compressive loading of driving the spin fin pile 16, shaft friction acts in an upward direction along the pile shaft above the spin fins 24 (as indicated in FIG. 6 by the upward arrows along the pile shaft). Effective end bearing of the spin fin pile 16 is exerted on the soil mass below the spin fins 24. Fin shaft friction acts in an upward direction on the spin fins 24 (as indicated by the upward arrows along the fins in FIG. 6). FIG. 7 illustrates pile tension load action of a spin fin pile 16, as in resisting forces on the above ground tower 12, acting to dislodge the spin fin pile 16 from its embedded position. During the tension loading acting on the spin fin pile 16 from the forces against the supported tower 12, initial shaft friction acts in a downward direction along the pile shaft above the spin fins 24. FIG. 7 indicates this by the downward arrows along the pile shaft. Effective end bearing of the spin fin pile 16 is exerted on the soil mass above the spin fins 24. Fin shaft friction acts in a downward direction on the spin fins 24 (as indicated by the downward arrows along the fins in FIG. 7).

Figure 8:
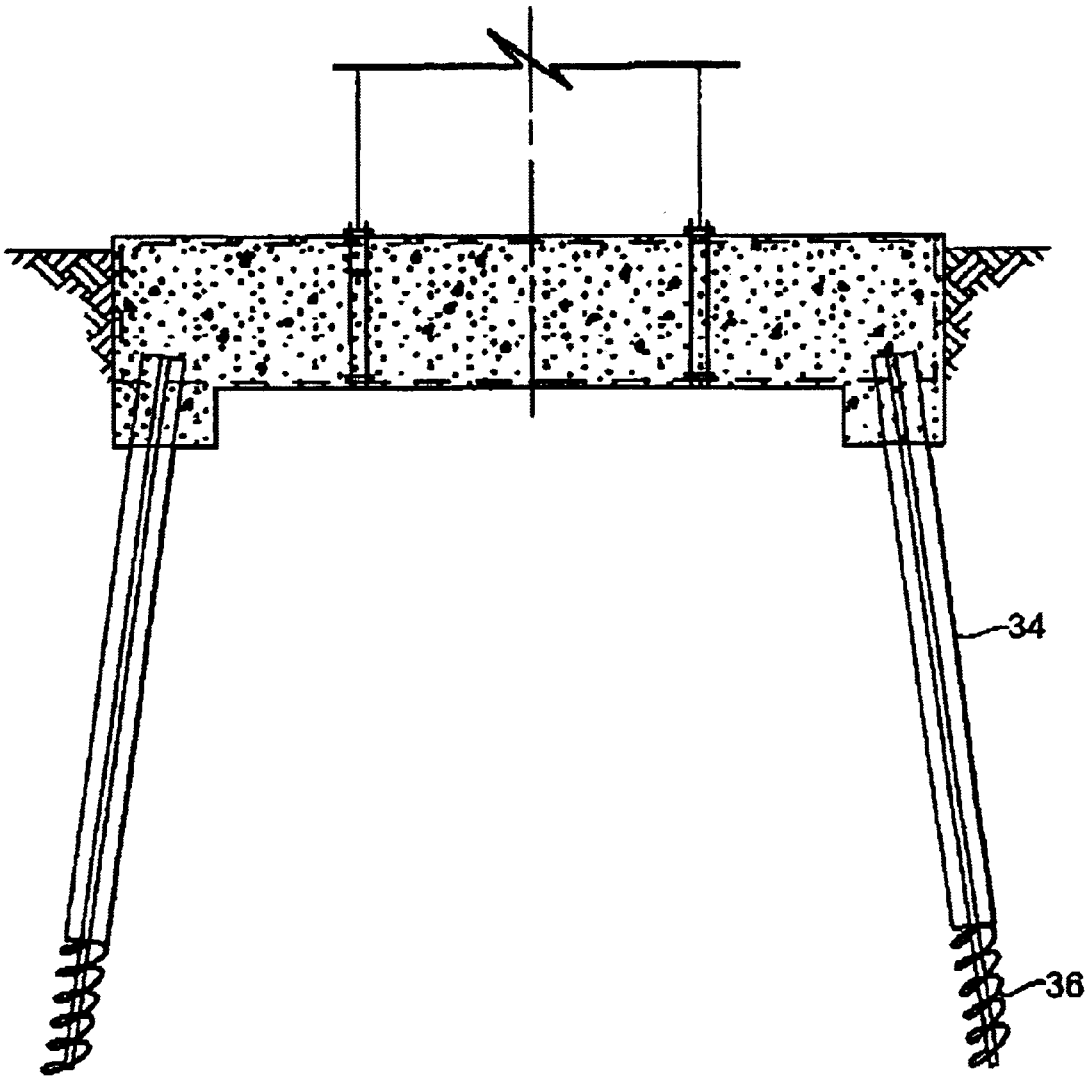
FIG. 8 shows a cylindrical pile with a helical screw soil anchor.
Figure 9:
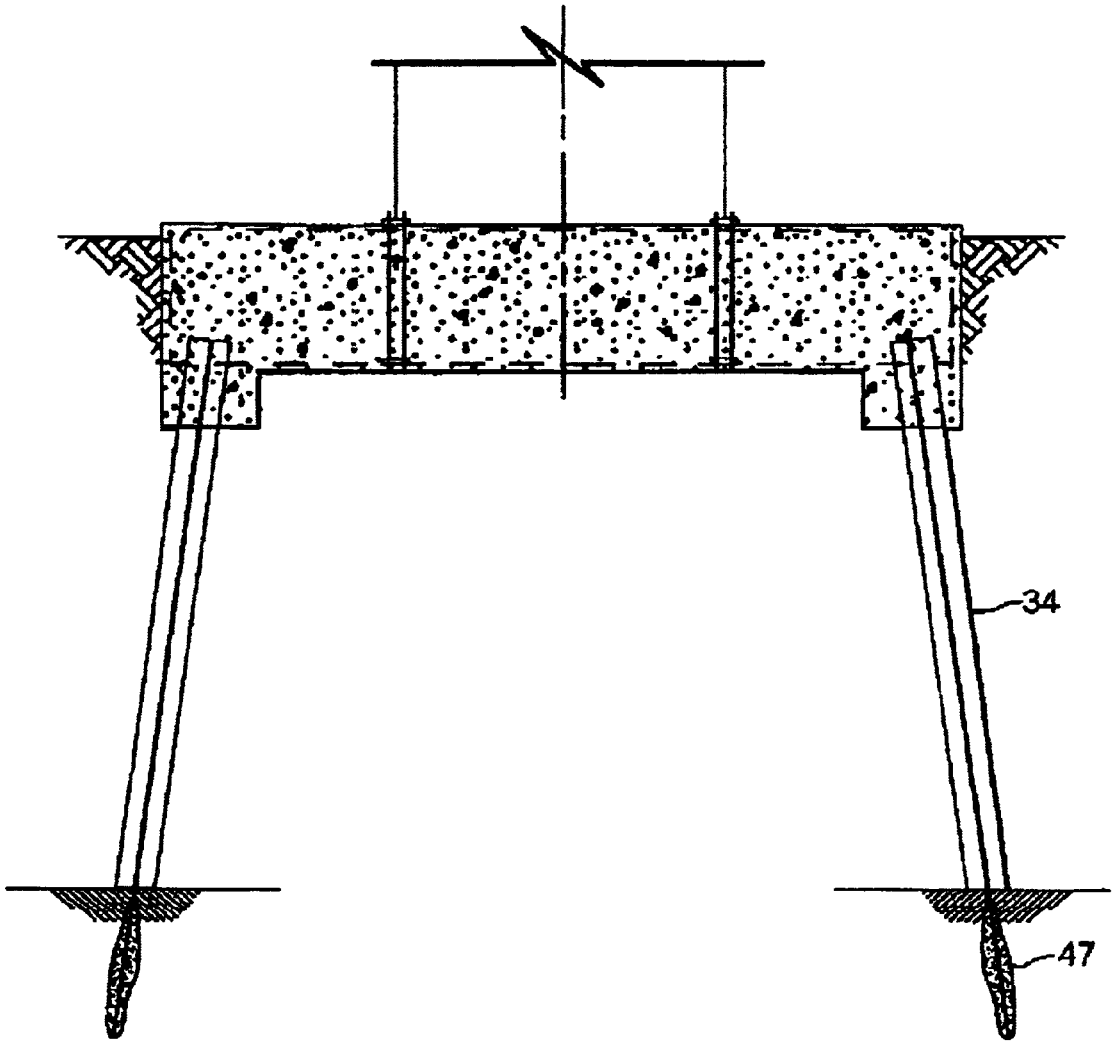
FIG. 9 shows a cylindrical pile with an embedded grouted soil or rock anchor.
Figure 10:
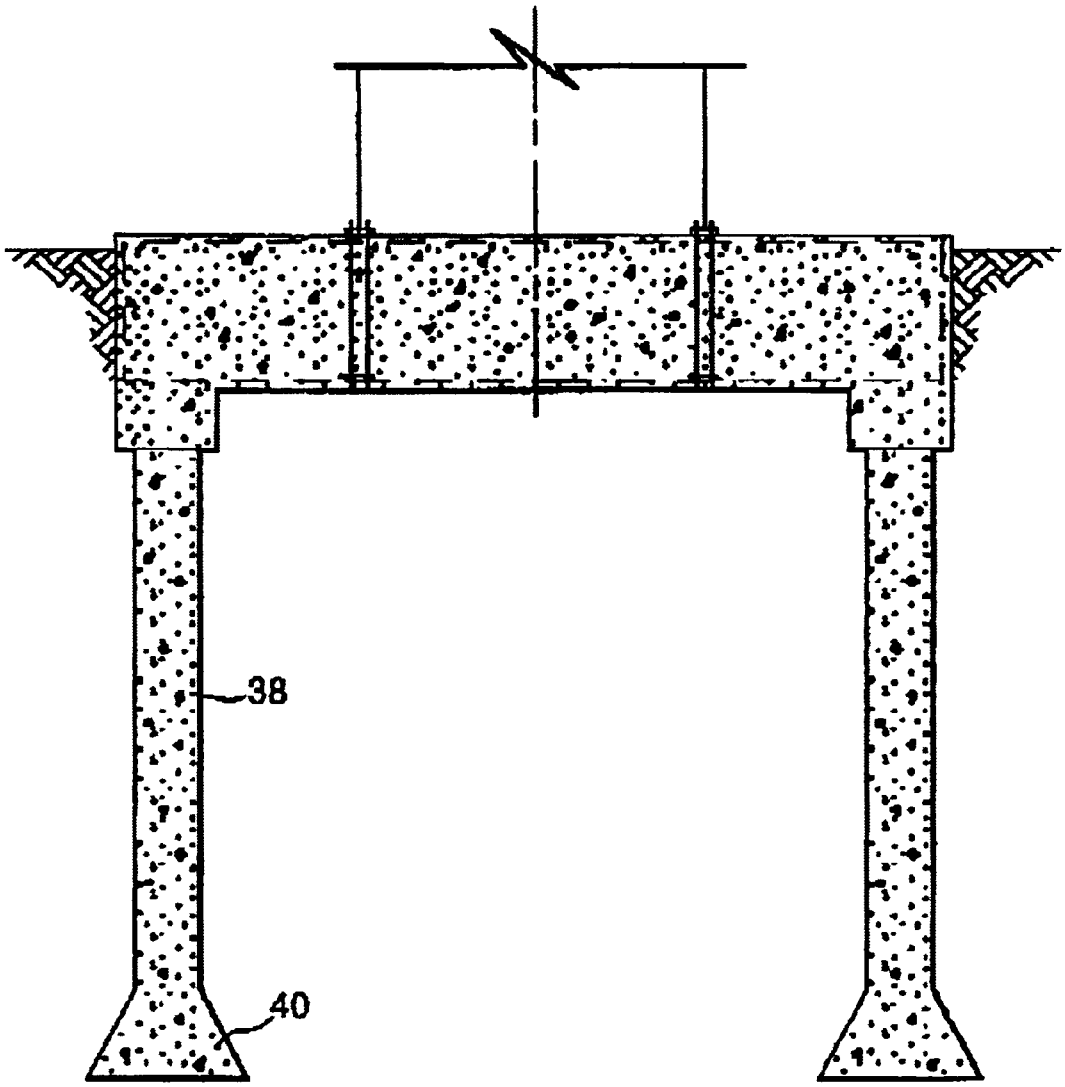
FIG. 10 shows a caisson with distal end belled section.
Figure 11:
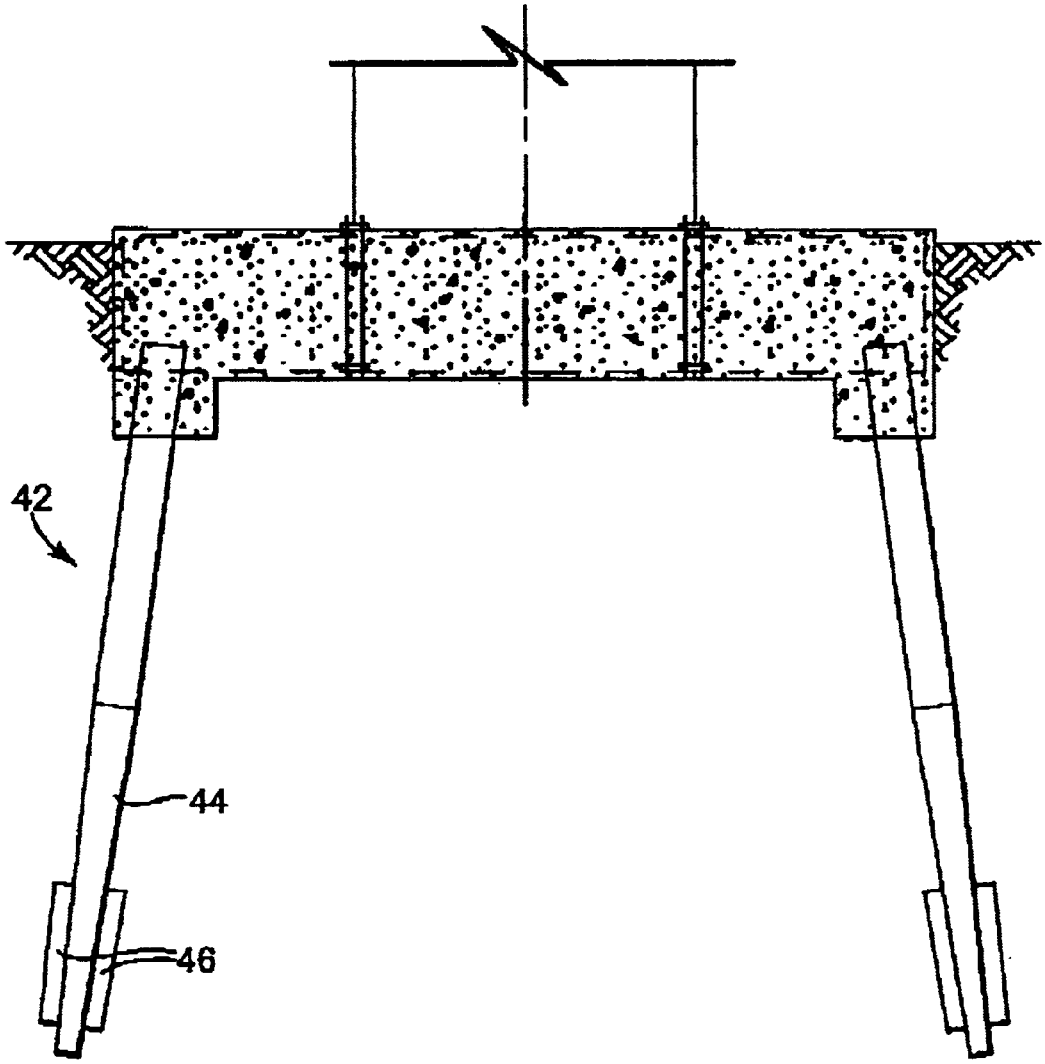
FIG. 11 shows a two-sectioned fluted spin fin pile with the section tapered.

FIG. 8 shows a foundation of the invention in which the tension/compression components are each a cylindrical pile 34 terminating distally in a helical screw anchor 36. The helical screw anchor 36 may be adapted for screw retention into soil and/or rock, depending on the configuration of the below ground soil structure. FIG. 9 shows a foundation of the invention in which the tension/compression components are each a cylindrical pile 34 terminating distally in an embedded grouted soil or rock anchor. FIG. 10 shows a foundation of the invention in which the tension/compression components are each a caisson 38 with distal end belled section 40. FIG. 11 shows a foundation of the invention in which the tension/compression components are each a two-sectioned pile 42. The lower pile section 44 tapers inwardly and distally and terminates in spin fins 46.

The spin fin piles embed in the concrete pile cap to provide the pile connection. Typically, about 1–3 feet of the upper end of the components embed into the concrete cap. Reinforcing or studs connect each component to the concrete and prevent rotation of the component. This construction keeps the components from twisting in the ground and from pulling out of the ground. A number of factors determine the size of the pile cap. These factors include the diameter of the above ground structure, the anchor bolt requirements, the component size, the location requirements of the components, and the structural requirements to transfer loads from the anchor bolts to the components. The number of components required increases as the foundation diameter decreases. As the diameter increases, the number of components decreases, but the structural requirements and volume of concrete for the cap increases. The lengths of the anchor bolts for the present inventive foundation may be shorter than anchor bolts for many other conventional foundation types. Group component analyses are available for governmental requirements and are commercially available.

Steel reinforcement of the concrete cap provides for the transfer of stresses from the components to the anchor bolts. The soil pressures against the cap and the mass of the cap assist in resisting the large overturning forces and, thereby, reduce the pile lateral and uplift loads. This reduces the lateral loading transferred to the inventive foundation. Testing confirms that above ground structure supported by a foundation of this invention demonstrates resistance to overturning moment forces of up to about 21,728,000 lb./ft. Testing confirms resistance to lateral loads of up to about 112,000 lbs., and to vertical loads of up to about 286,000 lbs.

A method of constructing a foundation according to the present invention is comprised as follows.

- Excavating the pile cap.
- Forming spin fin piles by welding the helical fins onto the round straight or tapered pipe pile.
- Driving the spin fin piles at the specified diameter spacing and batter.
- Placing the formwork, reinforcing and anchor bolts, or embedded flange bolt for the pile cap.
- Placing and curing the concrete for the pile cap
- Stripping the formwork.
- Backfilling and compacting around the pile cap.
- Placing the tower section and tightening the anchor bolts or embedded flange bolt.

The inventive foundation is suitable for a wide range of soil installation conditions where steel piles can be driven. These conditions include:

- Soil conditions above and below the groundwater table
- Non-cohesive (sand) soils
- Cohesive (clay) soils
- Upper soil layers comprised of organic or other soil types, generally considered to provide poor support for deep foundations
- Upper soil layers that are expansive or susceptible to frost heaving
- Combinations of soils and soil layers
- Rock conditions or combined soil and rock conditions The detailed construction for the foundation of the present invention may vary for different soil conditions and loadings. The relevant factors to consider include:

Piles. Layout of the piles, number of piles, pile group diameter, individual pile diameter, pile wall thickness, concrete infill, batter, and length, width, and thickness of fins.

Pile Cap. Volume-depth, tube positioning, reinforcing, anchor bolt or tube section positioning, and pile attachment and anchorage details.

The foundation of this invention using spin fin piles is particularly effective in soil conditions including high groundwater, soft upper soil layers, or significantly high-strength difficult-to-penetrate lower soils. The use of spin fin piles in the inventive foundation offers a number of benefits including:

The helical or spiral fins strengthen the distal below ground end of the pile, allowing the pile to be driven successfully in hard driving conditions. For example, spin fin piles have been driven successfully through heavy cobble end boulder layers.

Spin fin piles can be driven using standard, commercially available pile driving equipment.

The battered spin fin piles can be driven at little or no increase over the cost of driving traditional piles without spiral or helical fins. Battered spin fin piles allow widening the base of the structure at the bottom of the piles and offer increased resistance to a horizontal component of lateral and overturning resistance and stiffness.

The tension capacity of spin fin piles 16 has been compared to the tension capacity of piles with straight fins and without fins. Uplift load tests have been performed successfully on spin fin piles ranging in diameter from about 12 to about 16 inches. Spin fin piles have demonstrated increased ultimate tension and compression capacity, and no loss of strength after repetitive loading beyond yield point. Testing has indicated that the spin fin piles exhibit no loss of strength with repetitive loading, even if loaded beyond the yield point of the soil. The failure mode (if loaded to failure) has been shown to be progressive, not catastrophic. Filling the pile with concrete has been shown to further increase the structural capacity of the upper portion of the pile. This has provided composite concrete and steel action, increasing the strength and reducing the possibility of buckling the wall of the spin fin pile.

That which is claimed is:

1. An embedded high-tension, high-compression foundation for an above ground tower comprising:

a ground level cap for supporting the tower;

attachments to secure the tower to the cap; and embedded tension/compression components secured to the cap and terminating only distally with a bearing surface resistant to pullout and overturning forces to provide embedded tension retention of the components within a terminal soil/rock mass;

wherein the components extend to deep, high-strength soil layers in absence of deep wide-area excavation to provide exceptional bearing and tension capacity, high resistance to overturning moment forces acting on the tower, and compression significantly higher than the tension capacity.

2. A foundation according to claim 1, wherein the components are selected from piles with distal end helical fins, piles with a distal end grouted soil or rock anchor, piles with a distal end helical screw anchor, caissons with a distal belled section, caissons with a distal end grouted soil or rock anchor, caissons with a distal end helical screw anchor, and combinations thereof.

3. A foundation according to claim 1, wherein the components are concrete filled.

4. A foundation according to claim 1, wherein the components are battered outwardly from the cap and tower.

5. A foundation according to claim 1, which exhibits tension of from about 50,000 lbs. to about 150,000 lbs. for each component.

6. A foundation according to claim 1, which exhibits compression about 50% higher than tension capacity.

7. A foundation according to claim 1, which supports an above ground structure resistant to overturning moment forces of greater than 20,000,000 lb./ft., lateral loads of more than 110,000 lbs., and vertical loads of more than 280,000 lbs.

8. A method of constructing an embedded high-tension, high-compression foundation for an above ground tower comprising:

establishing a minimal ground-level excavation for a cap;

embedding below ground level tension/compression components that terminate only distally in a bearing surface to provide below ground tension retention within a terminal soil/rock mass absent deep wide area excavation, so that the components extend to deep, high-strength soil layers to provide exceptional bearing and tension capacity, high resistance to pullout and overturning forces, and compression significantly higher than the tension capacity forming the cap; and securing the cap to the components.

9. A method according to claim 8, wherein the tension/compression components are selected from piles with a distal end helical fin, piles with a distal end grouted soil or rock anchor, piles with a distal end helical screw anchor, caissons with a distal belled section, caissons with a distal end grouted soil or rock anchor, caissons with a distal end helical screw anchor, and combinations thereof.

10. A method according to claim 8, including filling the tension/compression components with concrete.

11. A method according to claim 8, including battering the components outward from the cap and tower during embedding.

12. A method according to claim 8, wherein embedding comprises positioning the component at ground level and imparting impetus to plunge the component through intervening soil/rock to its desired final location.

13. A method according to claim 8, wherein embedding comprises establishing a hole in intervening soil/rock of dimensions essentially equal to a desired final location of a component and positioning the component within the hole.

14. An embedded high-tension, high-compression foundation for an above ground tower comprising:

a ground level cap for supporting the tower;

attachment means for attaching the tower to the cap; and embedded tension/compression components secured to the cap and terminating distally with anchoring means to provide below ground tension embedded retention of the components within a terminal soil mass;

wherein the components extend to deep, high-strength soil layers in absence of excavation for embedding of the components to provide exceptional bearing and tension capacity, high resistance to overturning moment forces acting on the tower.

15. A foundation according to claim 14, wherein the components are selected from piles with distal end helical fins, piles with a distal end grouted soil or rock anchor, piles with a distal end helical screw anchor, caissons with a distal belled section, caissons with a distal end grouted soil or rock anchor, caissons with a distal end helical screw anchor, and combinations thereof.

16. A foundation according to claim 14, wherein the components are concrete filled.

17. A foundation according to claim 14, wherein the components are battered outwardly from the cap and tower.

18. A method of constructing an embedded high-tension, high-compression foundation for an above ground tower comprising:

establishing a minimal ground-level excavation for a cap;

embedding below ground level tension/compression components that terminate distally in an anchoring means to provide below ground tension retention within a terminal soil mass in absence of deep below-ground excavation, and extending the components to deep, high-strength soil layers to provide exceptional bearing and tension capacity;

forming the cap; and securing the cap to the components.

19. A method according to claim 18, wherein the tension/compression components are selected from piles with a distal end helical fin, piles with a distal end grouted soil or rock anchor, piles with a distal end helical screw anchor, caissons with a distal belled section, caissons with a distal end grouted soil or rock anchor, caissons with a distal end helical screw anchor, and combinations thereof.

20. An embedded high-tension, high-compression foundation for an above ground tower comprising:

a ground level cap for supporting the tower;

attachments to secure the tower to the cap; and embedded tension/compression components secured to the cap which are spin fin piles;

wherein the spin fin piles extend to deep, high-strength soil layers in absence of deep wide-area excavation to provide exceptional bearing and tension capacity, high resistance to overturning moment forces acting on the tower, and compression significantly higher that the tension capacity.

* * * * *